US006758343B1

(12) United States Patent
Soto

(10) Patent No.: US 6,758,343 B1
(45) Date of Patent: Jul. 6, 2004

(54) DUAL HYDRO-CYCLONE WITH WATER INJECTION

(75) Inventor: Oscar Castro Soto, Santiago (CL)

(73) Assignee: Weir Slurry Group, Inc., Madison, WI (US)

( * ) Notice: Subject to any disclaimer, the term of this patent is extended or adjusted under 35 U.S.C. 154(b) by 0 days.

(21) Appl. No.: 09/476,397

(22) Filed: Dec. 30, 1999

(30) Foreign Application Priority Data

Jun. 2, 1999 (CL) ..... 1140-99

(51) Int. Cl.[7] ..... B04C 5/26; B04C 5/103; B04C 5/181

(52) U.S. Cl. ..... 209/733; 209/726; 209/729

(58) Field of Search ..... 209/733, 726, 209/729, 731

(56) References Cited

U.S. PATENT DOCUMENTS

| | | | | | |
|---|---|---|---|---|---|
| 2,927,693 | A | * | 3/1960 | Freeman et al. | 209/731 |
| 3,277,926 | A | * | 10/1966 | Skardal | 138/46 |
| 3,421,622 | A | * | 1/1969 | Wurtmann | 209/731 |
| 3,598,731 | A | * | 8/1971 | Frykhult et al. | 210/94 |
| 3,802,570 | A | * | 4/1974 | Dehne | 210/304 |
| 3,861,532 | A | * | 1/1975 | Skardal | 209/728 |
| 4,226,707 | A | * | 10/1980 | Boivin | 209/731 |
| 4,389,307 | A | * | 6/1983 | Boadway | 209/728 |
| 4,597,859 | A | * | 7/1986 | Beck | 209/724 |
| 4,810,264 | A | * | 3/1989 | Dewitz | 48/210 |
| 4,842,145 | A | * | 6/1989 | Boadway | 209/719 |
| 5,131,980 | A | * | 7/1992 | Chamblee et al. | 162/4 |
| 5,173,177 | A | * | 12/1992 | Greenwood et al. | 209/170 |
| 5,560,818 | A | * | 10/1996 | Sharrow | 209/170 |
| 6,036,028 | A | * | 3/2000 | Jungmann et al. | 209/732 |
| 6,398,969 | B1 | * | 6/2002 | Hartmann | 210/742 |
| 6,544,416 | B2 | * | 4/2003 | Helwig | 210/304 |

FOREIGN PATENT DOCUMENTS

| | | | | |
|---|---|---|---|---|
| DE | 2355229 | * | 5/1974 | 209/733 |
| DE | 290096 | * | 5/1991 | 209/733 |

* cited by examiner

*Primary Examiner*—Donald P. Walsh
*Assistant Examiner*—Daniel K Schlak
(74) *Attorney, Agent, or Firm*—Morriss O'Bryant Compagni, PC

(57) ABSTRACT

The main technical problem with Dual Cyclones with Water Injection used as classifiers in grinding circuits is that they do not allow for control and regulation of the input velocity ratio between the first and second cyclone as well as the high pressure required at the intake of the first cyclone to achieve a sound operation of the second cyclone. The disclosed invention solves the technical problem by making the feeding and discharge of both cyclones' overflows form a volute in the horizontal plane with the body of the respective cyclone and by placing, between its bottom and the expansion zone, a selectively, axially-positionable member.

15 Claims, 3 Drawing Sheets

DUAL HYDRO-CYCLONE WITH WATER INJECTION

BACKGROUND OF THE INVENTION

1. Field of the Invention

This invention relates to hydro-cyclones of the type conventionally used in processing and classifying solids or solid/fluid phases. Specifically, this invention relates to dual hydro-cyclone systems which are structured to provide higher processing efficiencies through selectively, axially adjustable contact means and other novel structures.

2. Description of the Related Art

Grinding classification in the processing of ore is of great importance because an effective classification increases the capacity of the equipment and prevents material over-grinding. The current grinding circuits mainly use hydro-cyclones as classification equipment. The following are some of the main advantages of hydrocyclones:

1. They are small pieces of equipment with a high specific capacity, low residence time and low operational inertia, which is advantageous for the automatic control of grinding circuits.
2. They have a very simple structure, which in turn translates into low investment, operation and maintenance costs.
3. They are all-purpose pieces of equipment; i.e., they may be used as classifiers, thickeners, slime separators, pre-concentrators, solids scrubbers and fluid degassers.
4. They apply a high shear stress on the pulp feed and may thus be used for breaking agglomerates and classifying non-Newtonian pulps, which decrease their viscosity with an increased shear rate.

However, hydro-cyclones present the following disadvantages:

a) Although they are all-purpose pieces of equipment as to their application, they allow little modification of their characteristics in the event of a dramatic change in the conditions of the ore fed into the plant.

b) Hydro-cyclones are not specifically designed for a particular case or application, as they are usually manufactured in series. At most, they have a modular design to facilitate their assembly in such a way as to meet particular needs. Adaptation of these modules or equipment to meet particular needs is made empirically through tests at the industrial site itself. Obviously, this type of procedure is expensive and time consuming, but it is the only accurate method currently available.

c) One of their main disadvantages is their low efficiency. Their separation efficiency is given by three parameters: the short circuit, the cut-off size and cut-off sharpness or sharpness rate. The first parameter quantifies the rate of unclassified output of the cyclone's feed flow, which translates into lower throughput of the grinding circuit. The cut-off sharpness quantifies separation quality between coarse and fine during classification; this not only has an effect on its throughput and quality of the product, but also on the cut-off size.

Due to their hydrodynamic operational characteristics, hydro-cyclones used in grinding circuits of process plants have high shortcircuit rates, sometimes over 40%. One way of solving this problem is to use more diluted pulps and more concentrated discharge conditions. This solution is quite difficult to apply in high-capacity process plants because dilution requires an increased flow of pulp and also because the concentration process that follows the grinding process requires pulp with a controlled content of solids. Thus, most process plants operate under conditions that result in low efficiency of the hydro-cyclones, since this problem has not been satisfactorily solved. On the other hand, the hydro-cyclone's cut-off sharpness is low as the cut-off under size contains coarse material and the over size fraction contains fines.

The following are some of the alternatives that may also solve the hydro-cyclones' short-circuit problem:

Cyclone Cluster

It consists of a series of two or more cyclones. This results in a lower short-circuit rate, thereby improving the overall efficiency of the operation, but not the efficiency of the individual cyclones. The disadvantages of this solution are: a) an increased investment cost due to the number of cyclones involved; b) an increased operating cost due to the necessary intermediate pumping stages; c) an increased maintenance cost; and d) a more complex overall operation of the system.

Cyclone with Intrusive Apex or Mechanical Insert

It consists of a mechanical insert in the cyclone's apex. One of the main disadvantages of this solution is that the material used for the intrusive apex is too weak. Usually they should be built using abrasion-resistant, but weak ceramics. However, because the pulp contains metal fragments from the mill balls, bars and liners, they will eventually break and lose their sound classification properties.

Flat Bottom Cyclone

This type of hydro-cyclone does not have the bottom cone that ends in the discharge apex, but the cylindrical body ends in a flat bottom where the apex is inserted. It decreases the short-circuit of fines at discharge of the coarse material, but it increases the discharge or spill of coarse material due to the overflow of fines. While this solution increases the cyclone's efficiency from a specific throughput point of view, it affects its sharpness as the resulting output has more coarse material than obtained with the traditional cyclone; this results in a lower recovery rate in the flotation process, this aspect being its main disadvantage.

Dual Cyclone with Water Injection

It consists of two cyclone bodies assembled in a single casing with water jets on the apex that dilute the pulp and lower its viscosity, thereby improving its efficiency. The main problem is that it does not allow for the control and regulation of the following operational variables: a) the input velocity ratio between the first and second cyclone; and b) the high pressure required at the intake of the first cyclone to achieve a sound operation of the second cyclone, as otherwise the system will work just like a single cyclone. The technical issue of lack of control of the operational variables in this type of cyclone results in a lower separation efficiency due to poor sharpness index and the lack of control on the cut-off size; thus, one of the present invention's objectives is to solve this technical problem of the dual cyclone with water injection.

BRIEF SUMMARY OF THE INVENTION

In accordance with the present invention, a dual hydro-cyclone system is provided with a selectively, axially-positionable member located in the region of the bottom of a first hydro-cyclone which provides selective control of the amount of material passing from the first hydro-cyclone to the second hydro-cyclone of the system, thereby providing control of the processing parameters of any given application or use.

The inventor herein, having sought a solution to the technical problems described above with respect to conventional dual hydro-cyclone assemblies, and, after completing different tests and trials has discovered that if:

a) the feeding and discharge of both cyclones' overflows form a volute in the horizontal plane within the body of the respective cyclone; and b) the first cyclone, between its bottom and an expansion zone, has an axial positioning adjustable mechanical part or member, the operating variables may be successfully controlled. That is it allows for regulation and control of the intake velocity ratio between the first and second cyclone, and also the pressure at the intake of the first cyclone, thereby resulting in a lower working pressure requirement than that required in the traditional dual cyclone system.

BRIEF DESCRIPTION OF THE SEVERAL VIEWS OF THE DRAWINGS

In the drawings, which illustrate what is currently considered to be the best mode of the invention.

DETAILED DESCRIPTION OF THE INVENTION

The description of the invention shall be based on the figures.

Figure 1:
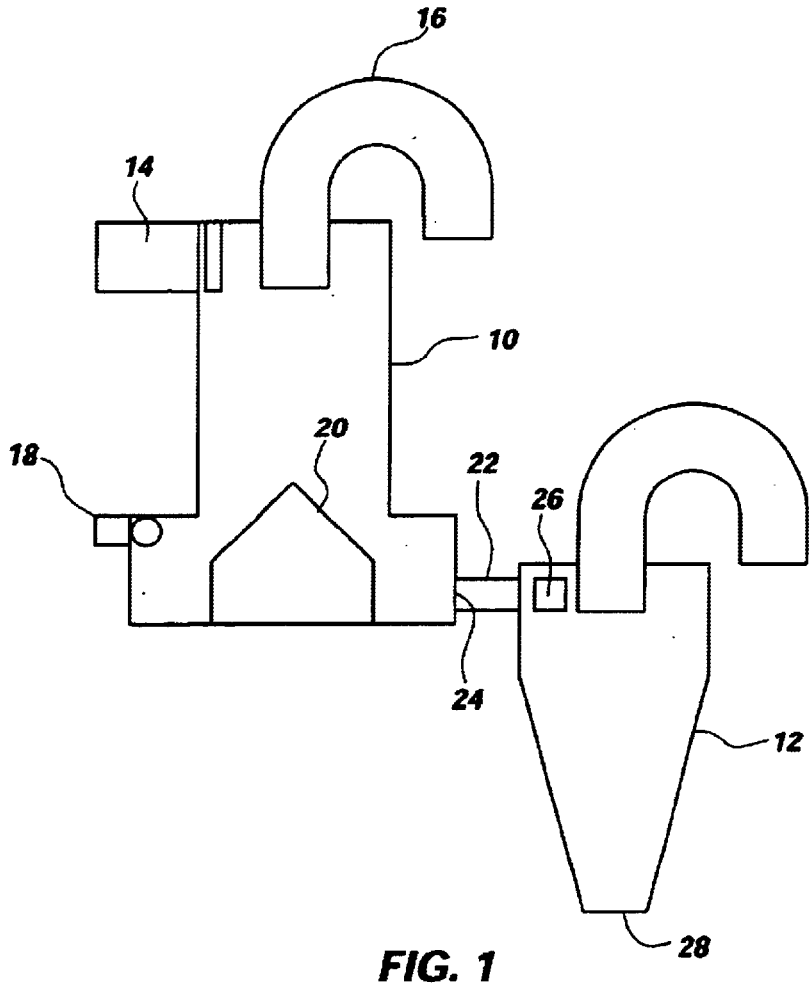
FIG. 1 (PRIOR ART)
FIG. 1 shows an elevational view in cross-section of a traditional dual cyclone system.
Figure 2:
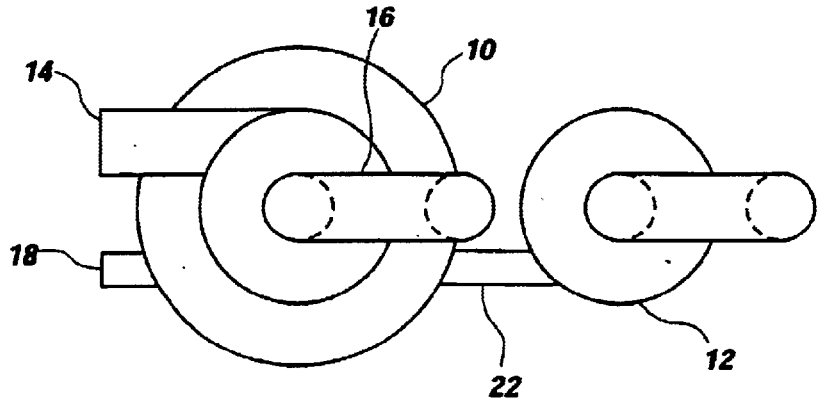
FIG. 2 (PRIOR ART)
FIG. 2 shows a plan view of the traditional dual cyclone system shown in FIG. 1.

The traditional dual cyclone system with water injection, as shown in FIGS. 1 & 2, consists of the primary cyclone 10 and the secondary cyclone 12. The feeding of the pulp to be classified takes place at the narrowed rectangular intake 14, tangential to the body of the primary cyclone 10 in a horizontal plane. The overflow of the primary cyclone 10 is carried out through the upper discharge U-pipe 16 in a vertical plane. Water is added through duct 18. The lower inverted cone 20 allows pressurization of the lower part of the primary cyclone 10 by injecting water in it, and redirects particles near the wall toward the center of the primary cyclone 10, creating at the same time a resistance to the semi-classified pulp flow to the secondary cyclone 12 through the pulp transfer duct 22 located between the first cyclone 10 and second cyclone 12. The transfer duct 22 has a circular cross section at the outlet 24 of the primary cyclone 10, and a narrowed rectangular section transition zone 26 to enter into the secondary cyclone 12. The secondary cyclone 12 has an axial lower outlet 28 or discharge pipe (apex). Given that the inverted cone 20 is fixed, it does not allow for regulation or control of the pulp flow into the secondary cyclone 12.

Figure 3:
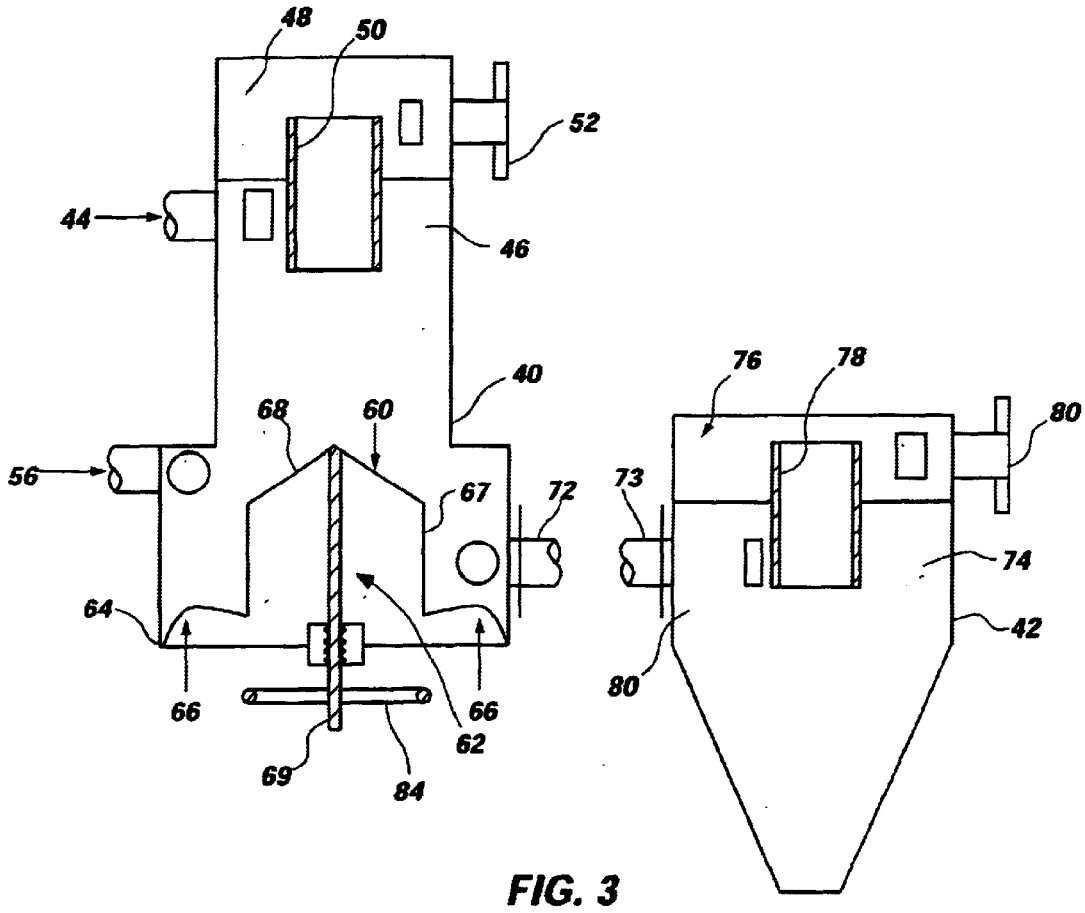
FIG. 3 shows an elevational view in partial cross-section of the system of choice with a dual cyclone system as a subject of the invention herein.
Figure 4:
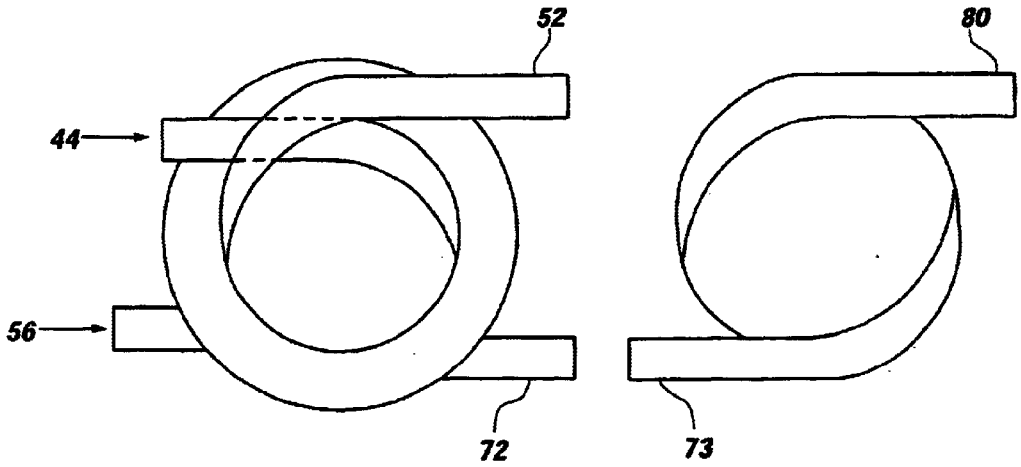
FIG. 4 shows a plan view of the dual cyclone system as a subject of the invention herein.

The new dual cyclone system with water injection of the present invention, as shown in FIGS. 3 & 4, consists of a first cyclone 40 and a second cyclone 42. Pulp to be classified is fed into tabloid intake 44, forming a volute within the body of the first cyclone 40 in a horizontal plane. The overflow of material from within the upper section 46 of the first cyclone 40 takes place through a first discharge chamber 48, which is attached to the first cyclone 40 through a vortex locator tube 50, which projects into the first discharge chamber 48. The diameter of the first discharge chamber 48 may preferably be equal in diameter to the upper section 46 of the first cyclone 40. The overflow moves out through the upper pipe 52 located alongside the horizontal plane or forming volute within the first discharge chamber 48, as shown in FIG. 4. Water is added through duct 56.

Figure 5:
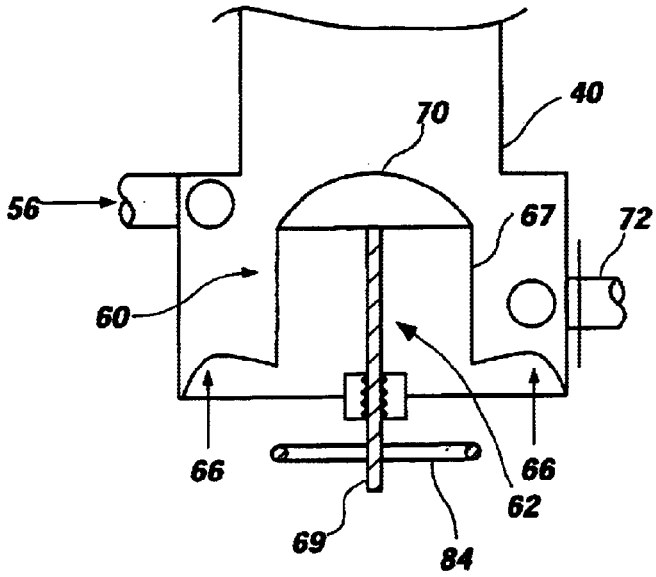
FIG. 5 is an enlarged view in elevation of an alternative embodiment of the selectively, axially positionable member.
Figure 6:
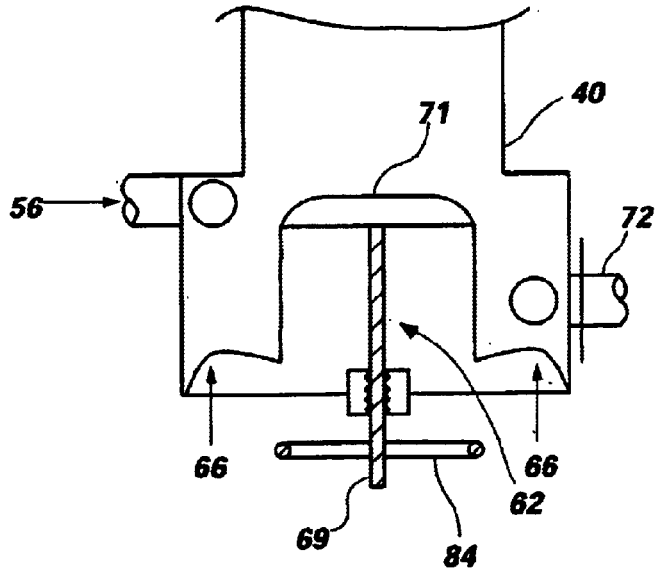
FIG. 6 is an enlarged view of another alternative embodiment of the selectively, axially positionable member.

A selectively, axially-positionable member 60, which is equipped with a position modulating device 62 in the axial position, is located near the bottom 64 of, and is connected to the first cyclone 40 through a flexible membrane 66, which allows for controlling the amount of material or pulp from the first cyclone 40 to the second cyclone 42. In this arrangement of choice, shown in FIG. 4, the selectively, axially-positionable member 60 comprises a cylindrical member 67 having an inverted cone top 68 which is axially adjustable by the position modulating device 62, here show as an axially movable rod 69. In other arrangements of choice, the upper part 70 of the selectively, axially positionable member 60 may be spherical, as shown in FIG. 5, or an elliptical-shaped surface 71, as shown in FIG. 6.

Transfer area 72, 73 is a circular to tabloid interface section taking place in the second cyclone 42 feed volute 74. The second cyclone 42 overflows through a second discharge chamber 76, which is attached to the second cyclone 42 by a vortex location tube 78, the pulp or material entering into the discharge chamber 76 and discharging out through the upper pipe 80 located in a horizontal plane, alongside or forming a volute within the second discharge chamber 76. Preferably, the diameter of the second discharge chamber 76 is equal to the diameter of the upper section 82 of the second cyclone 42.

The axial positioning or modulation of the selectively, axially-positionable member 60 may be done manually by means of the flywheel 82, or by other suitable means including, but not limited to that of electromechanic, hydraulic, air-operated devices or similar means.

What is claimed is:

1. Water jet dual hydro-cyclone comprising:

a first cyclone having a body, a top and a bottom, and having a feed intake configured to form a volute of fluid material in a horizontal plane within said body;

a water jet duct positioned in said first cyclone to introduce water below said volute formed in said body;

a selectively, axially positionable member positioned within said body of said first cyclone near said bottom;

a first discharge chamber attached to said first cyclone above said feed intake, said first discharge chamber being configured to produce a vortex within said first discharge chamber in a horizontal plane and having an upper pipe positioned in the horizontal plane to receive fluid from the vortex for discharge;

a first vortex locating pipe positioned between said first cyclone and said first discharge chamber;

a secondary cyclone having an intake configured to form a volute of fluid material in a horizontal plane within said secondary cyclone, said intake of said secondary cyclone being in fluid communication with said first cyclone;

a second discharge chamber attached to said second cyclone, said second discharge chamber being configured to produce a vortex within said second discharge chamber in a horizontal plane and having an upper pipe positioned in the horizontal plane to receive fluid from the vortex for discharge; and a second vortex locating pipe positioned between said second cyclone and said second discharge chamber.

2. The water jet dual hydro-cyclone of claim 1 further comprising a transfer area extending between said first cyclone and said intake of said second cyclone.

3. The water jet dual hydro-cyclone of claim 2 wherein said transfer area comprises an interface between said first cyclone and said second cyclone which transitions from being circular in cross section near said first cyclone to being a narrowed triangular shape in cross section near said second cyclone.

4. The water jet dual hydro-cyclone of claim 2 wherein said water jet duct is positioned in a horizontal plane and said transfer area is positioned in a horizontal plane which is below said horizontal plane of said water jet duct.

5. The water jet dual hydro-cyclone of claim 1 wherein said first cyclone body has a selected diameter proximate said top and said first discharge chamber has a diameter approximately equal to said diameter of said first cyclone body, and further wherein said second cyclone has a selected diameter in proximity to said intake and said second discharge chamber has a diameter approximately equal to said diameter of said second cyclone.

6. The water jet dual hydro-cyclone of claim 1 wherein said selectively, axially adjustable member is attached to said first cyclone body by a flexible membrane to facilitate selectively axial movement of said adjustable member.

7. The water jet dual hydro-cyclone of claim 6 wherein said selectively, axially positionable member further comprises an inverted cone, the apex of which is oriented to extend toward said first discharge chamber.

8. The water jet dual hydro-cyclone of claim 6 wherein said selectively, axially positionable member further comprises a cylinder-shaped, axially-oriented member having an upper surface thereof which is spheroidal in shape.

9. The water jet dual hydro-cyclone of claim 6 where said selectively, axially positionable member further comprises a cylinder-shaped, axially-oriented member having an upper surface thereof which is elliptical in shape.

10. The water jet dual hydro-cyclone of claim 1 wherein said selectively, axially positionable member is adjustable by manual operating means.

11. The water jet dual hydro-cyclone of claim 1 wherein said selectively, axially positionable member is adjustable by electromechanical operating means.

12. The water jet dual hydro-cyclone of claim 1 wherein said selectively, axially positionable member is adjustable by hydraulic operating means.

13. The water jet dual hydro-cyclone of claim 1 wherein said selectively, axially positionable member is adjustable by pneumatic operating means.

14. A water jet dual hydro-cyclone, comprising:

a first cyclone having a body, a top, a bottom, a feed intake positioned near said top and a vortex locating pipe positioned to receive pulp from said feed intake and to produce a volute in said first cyclone body;

a water jet duct positioned in said first cyclone body and spaced from said feed intake to introduce water into said first cyclone body in a horizontal plane below said vortex locating pipe;

a second cyclone having an intake in fluid communication with said first cyclone, said intake of said second cyclone being positioned in a horizontal plane below said horizontal plane of said water jet duct; and a selectively axially-positionable member positioned within said body of said first cyclone near said bottom to control the flow rate of pulp from said first cyclone to said second cyclone.

15. The water jet dual hydro-cyclone of claim 14 further comprising a transfer zone between said first cyclone and said intake of said second cyclone the cross section of which transitions from being circular near said first cyclone to being a narrowed rectangular shape at said intake of said second cyclone.

* * * * *